US009065231B2

(12) United States Patent
Cho

(10) Patent No.: US 9,065,231 B2
(45) Date of Patent: Jun. 23, 2015

(54) REVERSIBLE USB CONNECTOR

(75) Inventor: Seong Bean Cho, Bucheon-si (KR)

(73) Assignee: CLEAR ELECTRONICS, INC (KR)

( * ) Notice: Subject to any disclaimer, the term of this patent is extended or adjusted under 35 U.S.C. 154(b) by 144 days.

(21) Appl. No.: 13/521,480

(22) PCT Filed: Jan. 12, 2011

(86) PCT No.: PCT/KR2011/000227
§ 371 (c)(1),
(2), (4) Date: Jul. 11, 2012

(87) PCT Pub. No.: WO2011/087282
PCT Pub. Date: Jul. 21, 2011

(65) Prior Publication Data

US 2012/0276760 A1 Nov. 1, 2012

(30) Foreign Application Priority Data

Jan. 12, 2010 (KR) ..... 10-2010-0002720
Jan. 15, 2010 (KR) ..... 10-2010-0003761

(51) Int. Cl.
*H01R 24/00* (2011.01)
*H01R 24/62* (2011.01)
*H01R 13/453* (2006.01)

(52) U.S. Cl.
CPC ..... *H01R 24/62* (2013.01); *H01R 13/4538* (2013.01)

(58) Field of Classification Search
CPC ..... H01R 23/02
USPC ..... 439/660, 607.46, 218
See application file for complete search history.

(56) References Cited

U.S. PATENT DOCUMENTS 2,745,938 A * 5/1956 Brandler ..... 219/256
5,233,502 A * 8/1993 Beatty et al. ..... 361/679.09
5,289,339 A * 2/1994 Akashi et al. ..... 361/679.31
5,387,110 A * 2/1995 Kantner et al. ..... 439/59

(Continued)

FOREIGN PATENT DOCUMENTS

KR 1020060018342 3/2006
KR 1020060065658 6/2006

(Continued)

OTHER PUBLICATIONS

International Search Report—PCT/KR2011/000227 dated Oct. 20, 2011.

*Primary Examiner* — Neil Abrams
(74) *Attorney, Agent, or Firm* — Cantor Colburn LLP

(57) ABSTRACT

Disclosed herein is a two-way plug which can be inserted into a connection port regardless of the orientation of the plug. The two-way plug includes a rectangular frame, a hard substrate and four connection terminals. The rectangular frame is inserted into a connection port such that the rectangular frame is supported by the connection port. The substrate is disposed in a central portion of the rectangular frame. The four connection terminals are formed on each of the two surfaces of the substrate to form a symmetrical structure. Regardless of the orientation of the rectangular frame inserted into the connection port, the four connection terminals formed on one surface of the substrate are each connected to one of four connection pins provided in the connection port, and the four connection terminals formed on the other surface of the substrate are prevented from coming into contact with a tension pin provided in the connection port.

3 Claims, 6 Drawing Sheets

(56) References Cited

U.S. PATENT DOCUMENTS

| | | | | |
|---|---|---|---|---|
| 5,404,268 | A * | 4/1995 | O'Connor | 361/679.31 |
| 5,472,351 | A * | 12/1995 | Greco et al. | 439/353 |
| 5,540,601 | A * | 7/1996 | Botchek | 439/502 |
| 5,576,530 | A * | 11/1996 | Hagerty | 235/462.47 |
| 5,773,901 | A * | 6/1998 | Kantner | 307/125 |
| 6,139,365 | A * | 10/2000 | Lok | 439/607.01 |
| 6,145,037 | A * | 11/2000 | Sakakibara | 710/301 |
| 6,190,190 | B1 * | 2/2001 | Daly et al. | 439/218 |
| 6,981,887 | B1 * | 1/2006 | Mese et al. | 439/244 |
| 7,094,086 | B2 * | 8/2006 | Teicher | 439/173 |
| 7,094,089 | B2 * | 8/2006 | Andre et al. | 439/218 |
| 7,144,262 | B2 * | 12/2006 | Cheng | 439/151 |
| 7,458,825 | B2 * | 12/2008 | Atsmon et al. | 439/78 |
| 7,500,861 | B2 * | 3/2009 | Harkabi et al. | 439/218 |
| 7,537,471 | B2 * | 5/2009 | Teicher | 439/172 |
| 7,589,536 | B2 * | 9/2009 | Terlizzi et al. | 324/538 |
| 7,682,169 | B2 * | 3/2010 | Park | 439/159 |
| 7,717,717 | B1 * | 5/2010 | Lai | 439/66 |
| 7,758,359 | B2 * | 7/2010 | Chiu et al. | 439/131 |
| 8,174,847 | B2 * | 5/2012 | Ohtsuji et al. | 361/818 |
| 8,198,563 | B2 * | 6/2012 | Tsai | 218/140 |
| 8,461,465 | B2 * | 6/2013 | Golko et al. | 174/359 |
| 8,535,075 | B1 * | 9/2013 | Golko et al. | 439/218 |
| 8,647,156 | B2 * | 2/2014 | Golko et al. | 439/668 |
| 8,686,600 | B2 * | 4/2014 | Terlizzi et al. | 307/125 |
| 8,708,745 | B2 * | 4/2014 | Golko et al. | 439/607.41 |
| 2002/0142635 | A1 * | 10/2002 | Pan | 439/101 |
| 2003/0171035 | A1 * | 9/2003 | Yoo | 439/638 |
| 2004/0023560 | A1 * | 2/2004 | Swoboda | 439/638 |
| 2005/0079738 | A1 * | 4/2005 | Ahn | 439/1 |
| 2007/0243769 | A1 | 10/2007 | Atsmon et al. | |
| 2009/0137155 | A1 * | 5/2009 | Yeh et al. | 439/626 |
| 2010/0279520 | A1 * | 11/2010 | Tsai | 439/62 |
| 2011/0136381 | A1 * | 6/2011 | Cho | 439/620.01 |
| 2012/0015561 | A1 * | 1/2012 | Tsai | 439/660 |
| 2012/0276760 | A1 * | 11/2012 | Cho | 439/77 |
| 2014/0113487 | A1 * | 4/2014 | Chen et al. | 439/607.01 |

FOREIGN PATENT DOCUMENTS

| | | | |
|---|---|---|---|
| KR | 1020090056918 | | 6/2009 |
| KR | 1020090120052 | | 11/2009 |
| WO | 2009069969 | * | 6/2009 |

* cited by examiner

REVERSIBLE USB CONNECTOR

BACKGROUND OF THE INVENTION

1. Field of the Invention

The present invention relates generally to a two-way plug which can be inserted into a connection port regardless of the orientation of the plug so that connection terminals of the plug can be connected to connection pins of the connection port without shorting a circuit and, more particularly, to a two-way plug which includes a rectangular frame which is brought into contact with and supported by the inner surface of the connection port, so that the plug is prevented from being undesirably removed from the connection port by incidental external shock, and connection terminals of the plug can be stably maintained in a state of having been connected to the connection pins of the connection port for a long period of time.

2. Description of the Related Art

Various communication devices, such as PCs, MP3s, PDAs, digital cameras, cellular phones, etc., have recently been developed and marketed. Furthermore, data communication between such communication devices has increased.

To realize data communication between communication devices, connection ports are provided in the communication devices, and a cable having plugs provided on both ends thereof connects the communication devices to each other to allow data transfer therebetween when the plugs are inserted into the respective connection ports of the communication devices.

Generally, USB memory devices include a main body having memory, and a plug which is coupled to the main body such that one end of the plug is exposed out of the main body. The exposed end of the plug is inserted into and connected to the connection portion of a communication device. The other end of the plug is connected to the memory installed in the main body. Thereby, the plug facilitates data communication between the communication device and the memory of the USB memory device. When defined widely, memory is a kind of communication device.

Such a plug which facilitates data communication between communication devices includes a substrate and a plurality of connection terminals provided on the surface of the substrate.

To provide data communication, the connection terminals of the plug are connected to connection pins provided in the connection port into which the plug is inserted. In typical plugs, connection terminals are provided on only one surface of the substrate.

Thus, when a user inserts a typical plug into a connection port, he/she must pay attention to the orientation of the plug.

These days two-way plugs have been developed, and these do not require the user to pay attention to the orientation of a plug when it is inserted into a connection port. In such a two-way plug, connection terminals are arranged symmetrically on opposite surfaces of the substrate, so that regardless of the orientation of the plug when it is being inserted into the connection port, the connection terminals of the plug can be connected to connection pins of the connection port.

In detail, the connection pins which are connected to the connection terminals of the plug are provided in an upper (or lower) portion of the connection port. A tension pin is provided in a lower (or upper) portion of the connection port. The tension pin biases a substrate of the plug to the connection pins such that the connection pins are reliably connected to the connection terminals. The connection terminals are provided on each of opposite surfaces of the substrate. However, in the conventional two-way plug, when the connection terminals provided on one surface of the substrate are connected to the connection pins, the connection terminals provided on the other surface of the substrate may come into contact with the tension pin, thereby causing a short-circuit. Thus, the two-way plug typically includes a means for preventing short-circuiting.

Methods of prevent a short-circuit include a method that prevents the connection terminals from coming into contact with the tension pin using a mechanical structure and another method that uses a circuit. Techniques proposed in Korean Patent Registration No. 0626909 entitled "USB plug with two sides selectively connectable to USB port" and in Korean Patent Laid-open Publication No. 2006-65658 entitled "Electric connector" are representative examples of the method using the mechanical structure. An representative example of the method using the circuit was proposed in Korean Patent Laid-open Publication No. 2009-0120052 which was filed by the applicant of the present invention and entitled "Two-way plug equipped with circuit for preventing short-circuit"

The two-way plug of the present invention pertains to the method wherein a mechanical structure is used to prevent a short-circuit from being caused. In a manner similar to the technique of No. 2009-0120052, the two-way plug of the present invention includes a rectangular frame which surrounds a substrate, and the outer surface of the rectangular frame comes into contact with the inner surface of a connection port, thus preventing a short-circuit.

Generally, rather than the plug being easily inserted into the connection port without resistance, many users want to feel with their hand a slight contact resistance when the plug is inserted into the connection port, so that a user can perceive the insertion of the plug into the connection port and the connection of the connection terminals to the connection pins being made. Furthermore, users require that the plug be prevented from being undesirably removed from the connection port by an incidental external shock. The two-way plug having the rectangular frame can meet the requirements of the users.

FIG. 1 is a view showing the two-way plug, according to the conventional technique proposed in Korean Patent Laid-open Publication No. 2009-0120052. The plug 40 includes a rectangular frame 400, a substrate 401 which is disposed in the central portion of the rectangular frame 400, and connection terminals 403 which are provided on each of opposite surfaces of the substrate 401.

The substrate 401 comprises a flexible PCB. Thus, when the plug 40 is inserted into a connection port 100, the substrate 401 is bent when contact is made with a protruding plate 101 of the connection port 100 and it advances along the surface of the protruding plate 101. After this, the connection terminals 403 of the substrate 401 are connected to the connection pins 102 of the protruding plate 101.

However, in this conventional technique, there is a problem of low durability, making it difficult to use repetitively for a long period of time. The flexible PCB 401 is sufficiently elastic to be repeatedly bent, but the connection terminals 403 are formed on the flexible PCB 401 by plating metal, typically, copper, having low flexibility. Therefore, the thin connection terminals 403 which are applied on the surface of the flexible PCB 401 may crack after the flexible PCB 401 is bent a large number of times. If a crack occurs in a connection terminal 403, a defective connection between the connection terminal 403 and the corresponding connection pin 102 is induced, making the data communication unreliable.

In addition, there is a likelihood that after the flexible PCB 401 comes into contact with the protruding plate 101 of the connection port 100, it may not advance along the surface of the protruding plate 101 and thus may bend excessively at the position where it stops and break there. In the drawing, although the flexible PCB 401 is illustrated as being bent and advancing onto the surface of the protruding plate 101 which has the connection pins 102, there is a likelihood of the flexible PCB 401 being incorrectly bent and advanced onto the other surface of the protruding plate 101.

Moreover, in the conventional technique, the connection terminals 403 provided on one surface of the flexible PCB 401 are connected to the connection pins 102 provided on the protruding plate 101, and the connection terminals 403 provided on the other surface of the flexible PCB 401 come into contact with the inner surface of the rectangular frame 400. In other words, all the connection terminals 403 provided on opposite surfaces of the flexible PCB 401 come into contact with the connection pins 102 or the rectangular frame 400. Thus, frictional force on opposite surfaces of the flexible PCB 401 is increased, so that the flexible PCB 401 may not advance smoothly along the surface of the protruding plate 101. In contrast, if frictional force on opposite surfaces of the flexible PCB 401 is small (that is, if the gap between the flexible PCB 401 and the protruding plate 101 is comparatively large), the connection terminals 403 may not be reliably connected to the connection pins 102. Furthermore, if the connection terminals 403 or the connection pins 102 are worn after being used for a long period of time, the connection therebetween may become unstable.

SUMMARY OF THE INVENTION

Accordingly, the present invention has been made keeping in mind the above problems occurring in the prior art, and an object of the present invention is to provide a two-way plug which includes a rectangular frame such that the plug is maintained in a state of having been stably inserted into a connection port, wherein the plug has superior durability and thus can be repeatedly used for a long period of time, and connection terminals of the plug can be stably and reliably connected to connection pins of the connection port despite being used over a long period of time.

In order to accomplish the above object, the present invention provides a two-way plug, including, a rectangular frame inserted into a connection port such that an outer surface of the rectangular frame is brought into contact with and supported by an inner surface of the connection port, a hard substrate disposed in a central portion of the rectangular frame, and four connection terminals formed on each of opposite surfaces of the substrate to form a symmetrical structure such that when the substrate is turned upside down, a sequence of arrangement of the four connection terminals is the same, whereby regardless of an orientation of the rectangular frame inserted into the connection port, the four connection terminals formed on one of the opposite surfaces of the substrate are respectively connected to four connection pins provided in the connection port, and the four connection terminals formed on a remaining one of the opposite surfaces of the substrate are prevented from coming into contact with a tension pin provided in the connection port.

The two-way plug may further include a bending prevention means provided in the rectangular frame for supporting the substrate and preventing the substrate from bending.

The bending prevention means may comprise a support block interposed between an inner surface of the rectangular frame and each of the opposite surfaces of the substrate, and an elastic member coupled to a rear portion of the support block in the rectangular frame to elastically support the support block, whereby when the rectangular frame is inserted into the connection port, one of the support blocks is pushed backwards by a protruding plate on which the connection pins are provided, so that the connection terminals that are formed on the corresponding surface of the substrate are exposed out of the pushed support block and then connected to the connection pins, and a remaining one of the support blocks supports the remaining surface of the substrate to prevent the substrate from bending.

The bending prevention means may comprise seating depressions respectively formed on opposite sidewalls of the rectangular frame, the seating depressions supporting the substrate in such a way that opposite edges of the substrate are respectively seated into the seating depressions.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
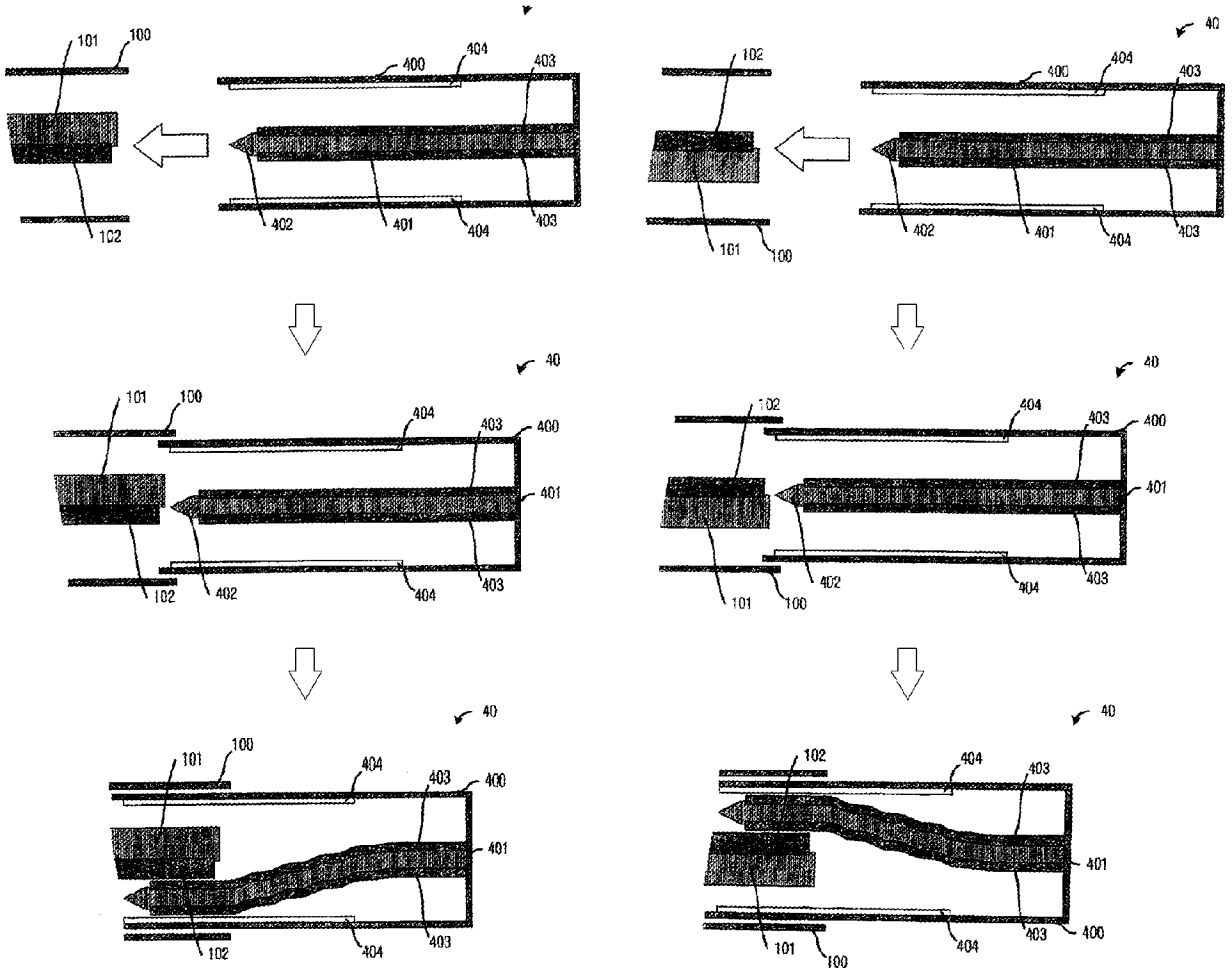
FIG. 1 Prior Art
FIG. 1 is a view showing one example of a two-way plug, according to a conventional technique.
Figure 2:
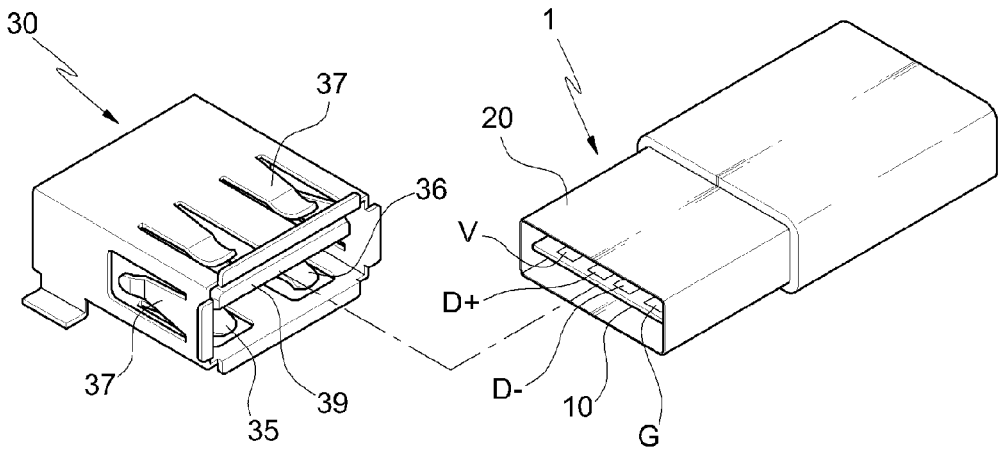
FIG. 2 is a perspective view showing one example of a connection port and a USB memory device equipped with a two-way plug having a rectangular frame, according to the present invention.

Hereinafter, a two-way plug according to the present invention will be described in detail with reference to the attached drawings.

As shown in the drawings, the two-way plug 1 according to the present invention includes a substrate 10, a plurality of connection terminals V, D+, D− and G, a rectangular frame 20 and a bending prevention means 41 or 45. The connection terminals V, D+, D− and G are provided on opposite surfaces of the substrate 10. The rectangular frame 20 surrounds the substrate 10. When the two-way plug 1 is inserted into a connection port 30, the rectangular frame 20 is brought into contact with and thus supported by the inner surface of the connection port 30. The bending prevention means 41 or 45 is provided in the rectangular frame 20 on opposite sides of the substrate 10 to prevent the substrate 10 from bending.

A PCB (printed circuit board) is generally used as the substrate 10. The substrate 10 is made of hard material having a hardness sufficient to prevent it from bending even though the substrate 10 collides with a protruding plate 39 of the connection port 30 when the two-way plug 1 is inserted into the connection port 30.

The substrate 10 is disposed such that the end of the substrate 10 is positioned inside the rectangular frame 20 to protect the substrate 10 from external shocks.

Furthermore, the substrate 10 is disposed in the central portion of the rectangular frame 20 and oriented in the longitudinal direction of the two-way plug 1, in other words, in the direction in which the two-way plug 1 is inserted into the connection port 30. Thus, regardless of the orientation of the two-way plug 1 inserted into the connection port 30, any one of the opposite surfaces of the substrate 10 is brought into contact with a first surface of the protruding plate 39 on which connection pins 31, 32, 33 and 34 are provided In addition, a ramp is formed on the end of at least one of the substrate 10 and the protruding plate 39, so that when the substrate 10 comes into contact with the protruding plate 39, the substrate 10 can be smoothly guided onto the first surface of the protruding plate 39 along the ramp.

The four connection terminals V, D+, D− and G are formed on each of the opposite surfaces of the substrate 10 to have a symmetric structure such that when the substrate 10 is turned onto its other side, the sequence of the arrangement of the four connection terminals V, D+, D− and G is the same. The connection terminals V, D+, D− and G are formed on each of the opposite surfaces of the substrate 10 in the same manner that the circuit patterns are formed on a PCB, in detail, by plating with a conductive material (e.g., copper), exposure, development, etching, etc.

The connection terminals V, D+, D− and G comprise a power terminal V to supply the drive power, a ground terminal G for grounding and two data terminals D+ and D− for data communication.

The four connection terminals V, D+, D− and G are arranged on each of the opposite surfaces of the substrate 10 so as to have a symmetrical structure.

In other words, when the ground terminal G, the two data terminals D+ and D− and the power terminal V are arranged on a first surface of the substrate 10 from left to right, the power terminal V, the two data terminals D+ and D− and the ground terminal G are arranged on a second surface of the substrate 10 from left to right. Thus, when the substrate 10 is turned onto its other side such that the second surface of the substrate 10 is disposed at a position at which the first surface thereof was, the ground terminal G, the two data terminals D+ and D− and the power terminal V become arranged on the second surface of the substrate 10 in order from left to right.

The four connection terminals V, D+, D− and G are respectively connected to the four connection pins 31, 32, 33 and 34 provided in the connection port 30, and data communication is thereby conducted. The connection port 30, the connection pins 31, 32, 33 and 34 provided in the connection port 30, and tension pins 35 and 36 are internationally standardized in size, arrangement, etc.

Figure 3:
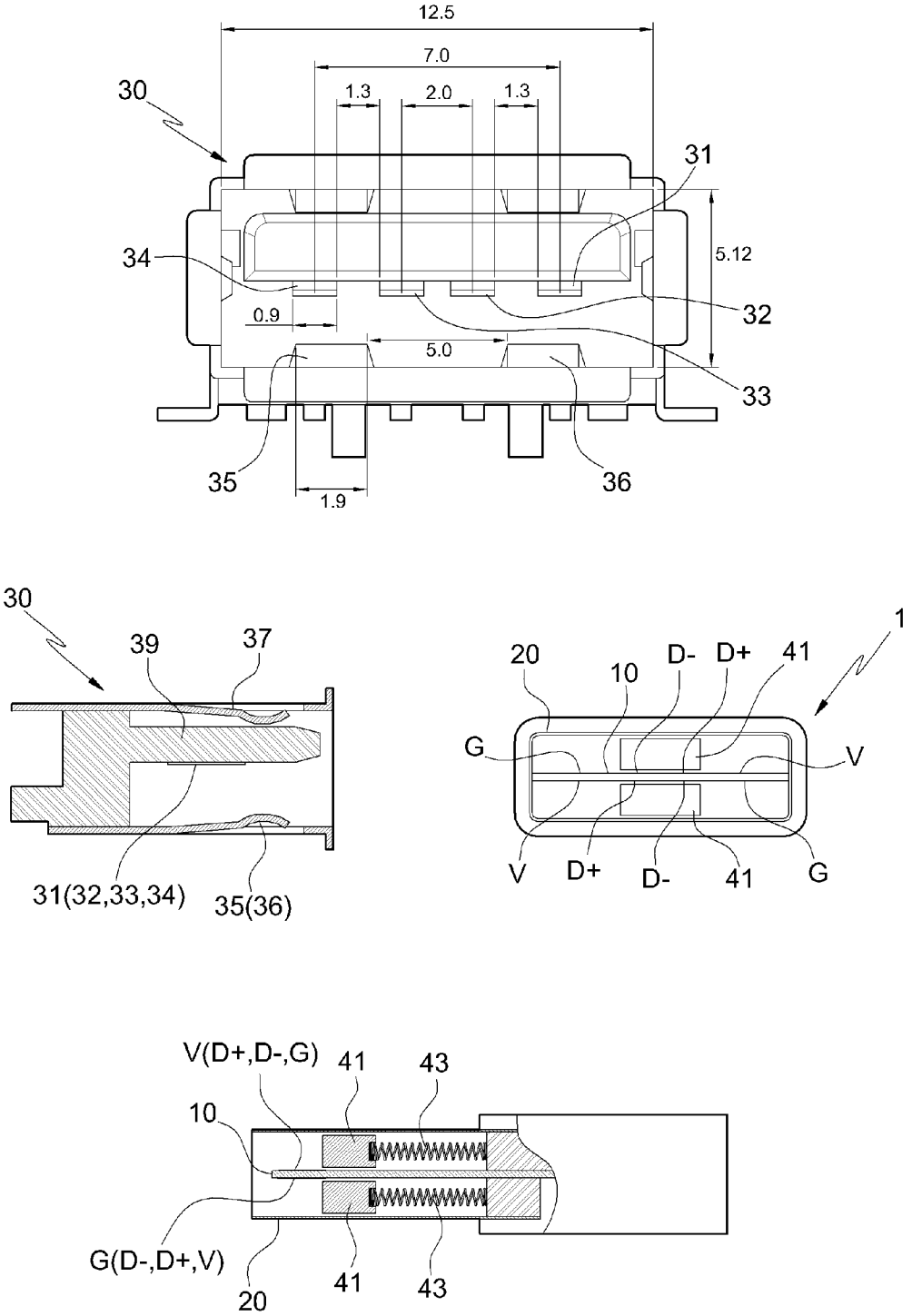
FIG. 3 is of front views and side sectional views of the connection port and the two-way plug according to the present invention.

For example, in the USB connection port 30 illustrated in FIG. 3, each of the four connection pins 31, 32, 33 and 34 has a width of 0.9 mm. The distance between the center of the power pin 31 and the center of the ground pin 34 is 7 mm. The distance between the centers of the two data pins 32 and 33 is 2 mm. The ground pin 34 is spaced apart from the data pin 33 by a distance of 1.3 mm, and the power pin 31 and the data pin are also spaced apart by a distance of 1.3 mm. Each tension pin 35, 36 has a width of 1.9 mm. The two tension pins 35 and 36 are spaced apart by a distance of 5 mm.

A lateral width of the inner space of the connection port 30 12.5 mm, and a height of the inner space thereof is 5.12 mm.

The first surface of the protruding plate 39 on which the connection pins 31, 32, 33 and 34 are provided is disposed at the center of the connection port 30 or at a position displaced from the center of the connection port 30 towards a second surface of the protruding plate 39. The tension pins 35 and 36 are provided on the inner surface of the connection port 30 which faces the connection pins 31, 32, 33 and 34.

In correspondence with the international standards of the connection port 30, the plug 1 is manufactured such that the connection terminals V, D+, D− and G provided on the substrate 10 are correctly connected to the corresponding connection pins 31, 32, 33 and 34 of the connection port 30.

The rectangular frame 20 surrounds the substrate 10 disposed at the center thereof. The outer surface of the rectangular frame 20 is brought into contact with the inner surface of the connection port 30. Thereby, the tension pins 35 and 36 which protrude inwards from the inner surface of the connection port 30 are brought into contact with the outer surface of the rectangular frame 20 and are thus prevented from coming into contact with the connection terminals V, D+, D− and G provided in the rectangular frame 20.

The outer surface of the rectangular frame 20 which is inserted into the connection port 30 is elastically supported by the tension pins 35 and 36 and the elastic pins 37 which protrude inwards from the inner surface of the connection port 30. Thus, the rectangular frame 20 can be prevented from being easily removed from the connection port 30 when subjected to external shock.

It is desirable that the rectangular frame 20 be made of metal having high abrasion resistance because it repeatedly comes into contact with the tension pins 35 and 36 and the elastic pins 37.

The bending prevention means 41 or 45 is provided inside the rectangular frame 20 and supports the substrate 10 to prevent the substrate 10 from bending attributable to contact resistance between the substrate 10 and the protruding plate when the substrate 10 comes into contact with the protruding plate 39 or after the substrate 10 has made contact with the protruding plate 39. The bending prevention means 41 or 45 may include seating depressions 45, or support blocks 41, or both of them. In addition to the seating depressions 45 or the support blocks 41, other bending prevention means may be used.

Figure 5A:
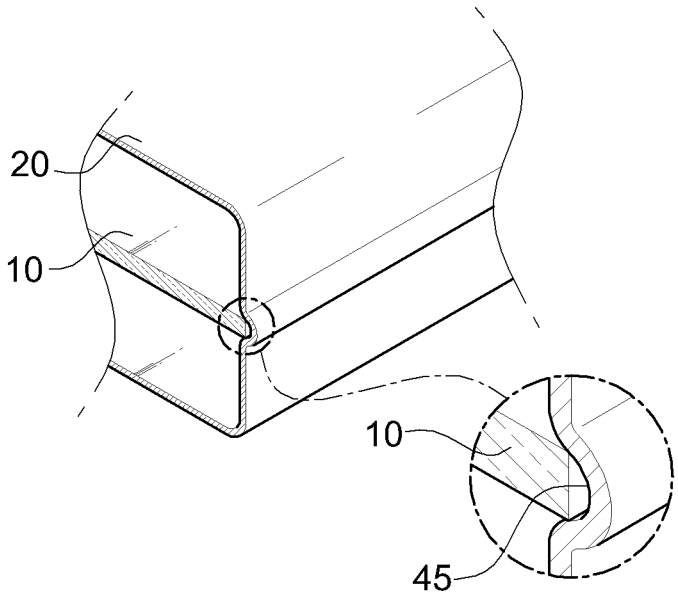
FIGS. 5A through 5C are perspective views showing various embodiments of a seating depression as a bending prevention means according to the present invention.
Figure 5B:
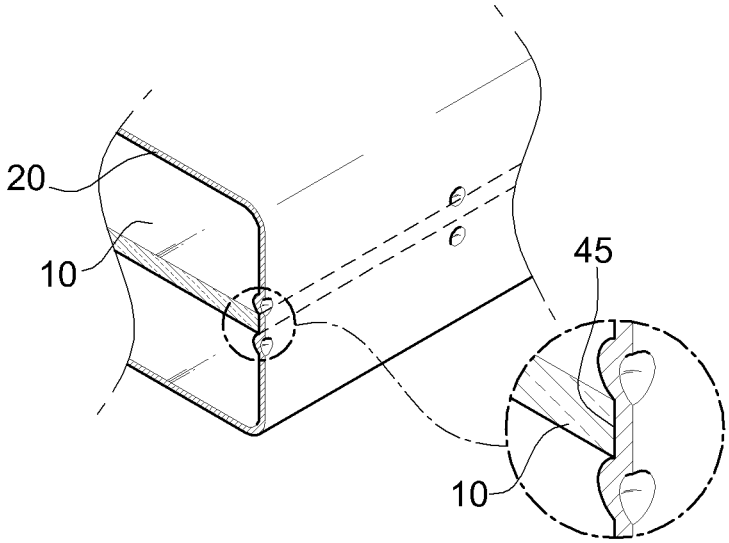
Figure 5C:
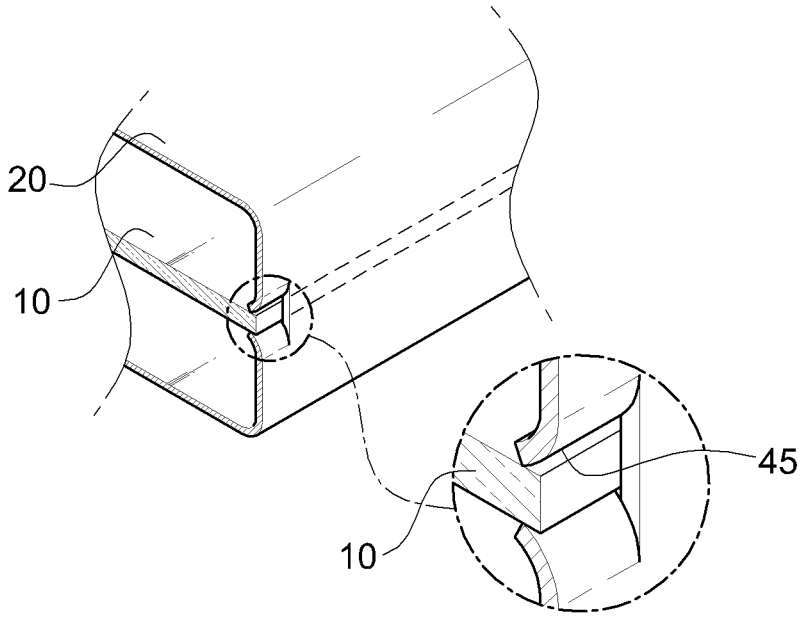

As shown in FIGS. 5A through 5C, the bending prevention means 41 or 45 may comprise the seating depressions 45 which are each formed on both sidewalls of the rectangular frame 20 along the longitudinal direction of the rectangular frame 20 so that the opposite edges of the substrate 10 are seated into and supported by the corresponding seating depressions 45.

FIG. 5A illustrates one example of the structure of the seating depression 45 which extends in the longitudinal direction and is formed by depressing a portion of the inner surface of the sidewall of the rectangular frame 20 outwards such that the corresponding edge of the substrate 10 is seated into the depression 45. FIG. 5B illustrates another example of the structure of the seating depression 45 which is formed by providing two protrusions on the inner surface of the sidewall of the rectangular frame 20 such that the corresponding edge of the substrate 10 is seated into the depression 45. FIG. 5C illustrates another example of the structure of the seating depression 45 which is formed by cutting a portion of the sidewall of the rectangular frame 20 and bending the opposite edges of the cut portion inwards such that the corresponding edge of the substrate 10 is seated into a space between the opposite bent edges of the cut portion.

Figure 4:
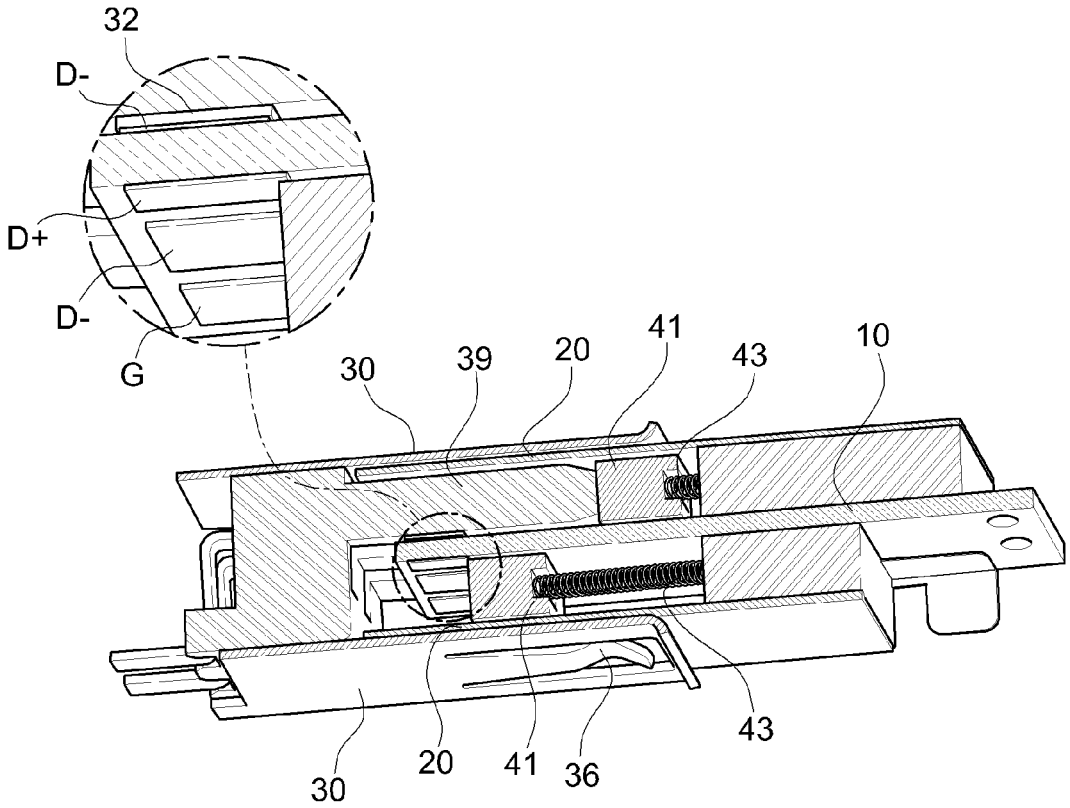
FIG. 4 is a partially broken perspective view showing insertion of the two-way plug into the connection port according to the present invention.

Furthermore, as shown in FIGS. 3 and 4, the bending prevention means may comprise the support blocks 41 and the elastic members 43.

The support blocks 41 are movably interposed between the inner surface of the rectangular frame 20 and the opposite surfaces of the substrate 10. The elastic members 43 are coupled to the rear portions of the corresponding support blocks 41 in the rectangular frame 20 to elastically support the support blocks 41.

Thus, when the two-way plug 1 is inserted into the connection port 30, one of the support blocks 41 is pushed backwards by the protruding plate 39 on which the connection pins 31, 32, 33 and 34 are provided, so that the connection terminals V, D+, D− and G which are formed on the corresponding side of the substrate 10 are exposed out of the pushed support block 41 and then connected to the connection pins 31, 32, 33 and 34. The support block 41 that is provided on the other side of the substrate 10 is maintained at its original position by the elastic force of the corresponding elastic member 43, thus supporting the corresponding side of the substrate 10 to prevent the substrate 10 from bending.

As described above, a two-way plug according to the present invention includes a rectangular frame so that when the plug is being inserted into a connection portion, the user can easily perceive whether the plug is completely inserted into the connection port and connection terminals of the plug are correctly connected to connection pins of the connection port. Furthermore, the plug can be prevented from being undesirably removed from the connection port by an incidental external shock. The two-way plug has superior durability and thus is able to be used repetitively over a long period of time without suffering from deformation or damage. Despite being used over a long period of time, the plug can be stably inserted into the connection port so that the connection terminals can be reliably connected to the connection pins.

Although the preferred embodiment of the two-way plug having the rectangular frame according to the present invention has been disclosed for illustrative purposes, those skilled in the art will appreciate that various modifications, additions and substitutions are possible, without departing from the scope and spirit of the invention as disclosed in the accompanying claims.

What is claimed is:

1. A two-way plug, comprising:

a rectangular frame capable of being inserted into a connection port such that an outer surface of the rectangular frame is brought into contact with and supported by an inner surface of the connection port;

a substrate disposed in a central portion of the rectangular frame;

four connection terminals formed on each of opposite surfaces of the substrate to form a symmetrical structure such that when the substrate is turned upside down, a sequence of arrangement of the four connection terminals is the same; and a support block interposed between an inner surface of the rectangular frame and each of the opposite surfaces of the substrate, the support block supporting the substrate and preventing the substrate from bending wherein, regardless of an orientation of the rectangular frame inserted into the connection port, the four connection terminals formed on one of the opposite surfaces of the substrate are respectively connected to four connection pins provided in the connection port, and the four connection terminals formed on a remaining one of the opposite surfaces of the substrate are prevented from coming into contact with a tension pin provided in the connection port.

2. The two-way plug as set forth in claim 1, further comprising an elastic member coupled to a rear portion of the support block in the rectangular frame to elastically support the support block, wherein, when the rectangular frame is inserted into the connection port, one of the support blocks is pushed backwards by a protruding plate on which the connection pins are provided, so that the connection terminals that are formed on the corresponding surface of the substrate are exposed out of the pushed support block and then connected to the connection pins, and a remaining one of the support blocks supports the remaining surface of the substrate to prevent the substrate from bending.

3. The two-way plug as set forth in claim 1, further comprising:

seating depressions respectively formed on opposite sidewalls of the rectangular frame, the seating depressions supporting the substrate in such a way that opposite edges of the substrate are respectively seated into the seating depressions.

* * * * *